US007446749B2

(12) United States Patent
Lee et al.

(10) Patent No.: US 7,446,749 B2
(45) Date of Patent: Nov. 4, 2008

(54) METHOD AND APPARATUS FOR MEASURING RESPONSE TIME OF LIQUID CRYSTAL, AND METHOD AND APPARATUS FOR DRIVING LIQUID CRYSTAL DISPLAY DEVICE USING THE SAME

(75) Inventors: Oh Hyun Lee, Kyoungsangbuk-do (KR); Don Gyou Lee, Kyoungsangbuk-do (KR); Jung Ho Kil, Kyoungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 835 days.

(21) Appl. No.: 10/874,547

(22) Filed: Jun. 24, 2004

(65) Prior Publication Data

US 2004/0263450 A1 Dec. 30, 2004

(30) Foreign Application Priority Data

Jun. 30, 2003 (KR) ..... 10-2003-0043805

(51) Int. Cl.
*G09G 3/36* (2006.01)

(52) U.S. Cl. ..... 345/101; 345/89; 345/690

(58) Field of Classification Search ..... 345/101, 345/89, 690

See application file for complete search history.

(56) References Cited

U.S. PATENT DOCUMENTS 5,495,265 A 2/1996 Hartman et al.
6,020,867 A * 2/2000 Shimada et al. ..... 345/87
7,038,647 B2 * 5/2006 Shigeta et al. ..... 345/89
2003/0107546 A1 6/2003 Ham

FOREIGN PATENT DOCUMENTS

| | | | |
|---|---|---|---|
| JP | 08-005974 | * | 1/1996 |
| JP | 2001-331154 | | 11/2001 |
| JP | 2002-082657 | | 3/2002 |
| JP | 2002-221949 | | 8/2002 |
| JP | 2004-264828 | | 9/2004 |
| WO | WO 99/05567 | | 2/1999 |

OTHER PUBLICATIONS

Communication from Japanese Patent Office dated Jan. 27, 2006.

* cited by examiner

*Primary Examiner*—Richard Hjerpe
*Assistant Examiner*—Leonid Shapiro
(74) *Attorney, Agent, or Firm*—McKenna Long & Aldridge LLP

(57) ABSTRACT

The method and apparatus for measuring response time of liquid crystal includes controlling temperature of a liquid crystal display panel, generating a liquid crystal driving signal having a variable voltage level that is changed according to a response property of the liquid crystal display panel and a target voltage level, and supplying the liquid crystal driving signal to the liquid crystal display panel, detecting the response property corresponding to the liquid crystal driving signal, and adjusting the variable voltage level until the response property reaches a desired level and setting a modulated data substantially equal to the variable voltage level when the response property reaches the desired level, the modulated data based on temperatures being determined by changing the temperature of the liquid crystal display panel. Also, method and apparatus for driving a LCD device using the above-described method.

15 Claims, 16 Drawing Sheets

METHOD AND APPARATUS FOR MEASURING RESPONSE TIME OF LIQUID CRYSTAL, AND METHOD AND APPARATUS FOR DRIVING LIQUID CRYSTAL DISPLAY DEVICE USING THE SAME

The present invention claims the benefit of Korean Patent Application No. P2003-43805 filed in Korea on Jun. 30, 2003, which is hereby incorporated by reference.

BACKGROUND OF THE INVENTION

1. Field of the Invention

The present invention relates to a liquid crystal display device, and more particularly to a method and apparatus for measuring the response time of the liquid crystal of which the optimal response time is automatically derived when the temperature of the liquid crystal is changed. Also, the present invention relates to a method and apparatus for driving a liquid crystal display device that might minimize the deterioration of picture quality which is generated when temperature of the liquid crystal display device is changed on the basis of the optimal response time derived by the method and apparatus of measuring the response time of the liquid crystal.

2. Description of the Related Art

In general, a liquid crystal display device controls light transmissivity of liquid crystal cells in accordance with video signals to display pictures. An active matrix type of liquid crystal display device, where a switching device is formed in each liquid crystal cell, has shown to be suitable for displaying motion pictures. The switching devices used in the active matrix type of liquid crystal display device is generally a thin film transistor (TFT).

The liquid crystal display device, as shown in the following formulas 1 and 2, has a disadvantage that its response time is slow due to its properties such as the unique viscosity and elasticity of liquid crystal.

$$\tau_r \propto \frac{\gamma d^2}{\Delta\varepsilon \,|\, V_a^2 - V_F^2 \,|} \qquad \text{[Formula 1]}$$

$\tau_r$ represents rising time when voltage is applied to liquid crystal, $V_a$ represents impressed voltage, $V_F$ represents Freederick Transition Voltage where liquid crystal molecules start to make tilt motion, and d represents the cell gap of liquid crystal cell, and $\gamma$ represents the rotational viscosity of liquid crystal molecule.

$$\tau_f \propto \frac{\gamma d^2}{K} \qquad \text{[Formula 2]}$$

$\tau_f$ represents the falling time during which liquid crystal is restored to its original position by elastic restoration after the voltage applied to the liquid crystal is turned off, and K represents the unique elastic modulus of liquid crystal.

The response time of liquid crystal of twisted nematic TN mode, which is a widely used liquid crystal mode in the liquid crystal display device, can be changed in accordance with the physical properties and cell gap of liquid crystal material, but generally its rising time is 20~80 ms and its falling time is 20~30 ms.

FIG. 1 is a diagram showing changes in brightness in accordance with data in a liquid crystal display device according to the related art. In FIG. 1, the response time of liquid crystal of twisted nematic TN mode is extended to the next frame before the voltage being charged the liquid cell with reaches a desired voltage, because the response time is longer than one frame period (NTSC: 16.67 ms), thus there appears the motion blurring phenomenon that screen gets blurred in motion pictures. In addition, a display brightness BL does not reach the desired brightness, so desired color and brightness are not able to be expressed, wherein the display brightness corresponds to the change of data VD from one level to another lever due to slow response time. As a result, the liquid crystal display device has motion blurring phenomenon appearing in motion picture and its picture quality going down due to the deterioration of contrast ratio.

In order to resolve the slow response time of such a liquid crystal display device, U.S. Pat. No. 5,495,265 and PCT international publication No. WO 99/05567 have introduced a scheme (hereinafter 'high speed driving method') that data are modulated in accordance with the existence or absence of the change of the data by use of a look-up table.

FIG. 2 is a diagram showing changes in brightness in a liquid crystal display device driven by a high speed driving method according to the related art and FIG. 3 is a diagram showing an example of eight-bit data using the high speed driving method according to the related art. In FIG. 2, the high speed driving method according to the related art modulates input data VD and applies the modulated data MVD to get desired brightness MBL. The high speed driving method has the value of $|V_a^2-V_F^2|$ in formula 1 on the basis of the existence or absence of change of the data in order to get the desired brightness corresponding to the brightness value of the input data within one frame period. Accordingly, the liquid crystal display device using the high speed driving method compensates the slow response time of liquid crystal by modulating the data value to ease motion blurring phenomenon in motion pictures, thereby displaying pictures in the desired color and brightness.

In other words, the high speed driving method selects modulated data Mdata corresponding to input data in a look-up table and modulates them as in FIG. 3 if there is any change between the most significant bit MSB data of a previous frame Fn-1 and a current frame Fn when comparing their most significant bit MSB data. Such a high speed driving method modulates only upper few bits in order to reduce the burden of memory capacity when realizing hardware.

FIG. 4 is a block diagram of a high speed driving apparatus according to the related art. In FIG. 4, the high speed driving apparatus according to the related art includes a frame memory 43 connected to an upper bit bus line 42 and a look-up table 44 commonly connected to the output terminals of the frame memory 43 and the upper bit bus line 42. The frame memory 43 stores most significant bit MSB data for one frame period and supplies the stored data to the look-up table 44. Herein, the most significant bit MSB data is set to be upper four bits of an eight bit source data RGB DataIn.

The look-up table 44 compares the most significant bit MSB data of the current frame Fn inputted from the upper bit bus line 42 with the most significant bit MSB data of the previous frame Fn-1 inputted from the frame memory 43, as in table 1, and selects a modulated data Mdata corresponding to the comparison result. The modulated data Mdata is added to the least significant bit LSB data from a lower bit bus line 41 to be applied to the liquid crystal display device. Table 1 represents one example of the look-up table 44 where the most significant four bits $2^4$, $2^5$, $2^6$, $2^7$ of the previous frame Fn-1 are compared with the most significant four bits $2^4$, $2^5$, $2^6$, $2^7$ of the current frame Fn to select the modulated data Mdata corresponding to the comparison result.

In case that the most significant bit MSB data is set to be 4 bits, the look-up table 44 of high speed driving method is implemented as in Tables 1 and 2.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In Tables 1 and 2, the leftmost column represents the data voltage VDn-1 of the previous frame Fn-1 and the uppermost row represents the data voltage VDn of the current frame Fn. Table 1 represents the information of a look-up table where most significant four bits $2^4$, $2^5$, $2^6$, $2^7$ are expressed in a decimal numeral. Table 2 represents the information of a look-up table in case that the weight of the most significant four bits $2^4$, $2^5$, $2^6$, $2^7$ in an eight bit data is applied to the data of Table 1.

However, the high speed driving method has a problem that its effect comes out differently in accordance with the category temperature of liquid crystal display device. Such a problem has been confirmed by an experimental result conducted using a trial product of 30" liquid crystal display module with a resolution of 1280×768 which is made by the applicant of this invention and is on trial sale.

Table 3 represents the response time (ms) of rising time and falling time for each of gray scales 0(G0), 63(G63), 127 (G127), 191(G191), 255(G255) in case that the above trial product is driven at 0° C. in a normal driving method like FIG. 1.

TABLE 3

| | Rising time | | | | |
|---|---|---|---|---|---|
| Falling time | G255 | G191 | G127 | G63 | G0 |
| G255 | | 26.7 | 29.3 | 31.0 | 31.1 |
| G191 | 50.3 | | 59.6 | 61.5 | 63.5 |

TABLE 3-continued

| | Rising time | | | | |
|---|---|---|---|---|---|
| Falling time | G255 | G191 | G127 | G63 | G0 |
| G127 | 45.9 | 51.2 | | 61.6 | 67.9 |
| G63 | 37.1 | 40.8 | 46.1 | | 64.4 |
| G0 | 27.0 | 25.5 | 24.3 | 26.0 | |

Table 4 represents the response time (ms) of rising time and falling time for each of gray scales 0(G0), 63(G63), 127 (G127), 191(G191), 255(G255) in case that the above trial product is driven at 0° C. in the high speed driving method.

TABLE 4

| | Rising time | | | | |
|---|---|---|---|---|---|
| Falling time | G255 | G191 | G127 | G63 | G0 |
| G255 | | 27.6 | 29.2 | 31.4 | 31.1 |
| G191 | 45.9 | | 49.2 | 54.5 | 57.8 |
| G127 | 43.4 | 44.8 | | 59.8 | 65.0 |
| G63 | 36.5 | 37.0 | 42.2 | | 55.8 |
| G0 | 24.6 | 24.2 | 23.6 | 24.7 | |

As shown in Tables 3 and 4, there is almost no difference in the rising time of liquid crystal cells between when the above trial product is driven at the using environment of 0° C. in the high speed driving method and when the above trial product is driven at the using environment of 0° C. in the normal driving method as in FIG. 1. In other words, there is difficulty in making the response time fast at a low temperature environment even if the liquid crystal display device is driven in the high speed driving method.

Table 5 represents the response time (ms) of rising time and falling time for each of gray scales 0(G0), 63(G63), 127 (G127), 191(G191), 255(G255) in case that the above trial product is driven at 25° C. in the high speed driving method.

TABLE 5

| | Rising time | | | | |
|---|---|---|---|---|---|
| Falling time | G255 | G191 | G127 | G63 | G0 |
| G255 | | 10.0 | 10.9 | 11.4 | 12.1 |
| G191 | 11.0 | | 11.8 | 11.6 | 11.4 |
| G127 | 11.7 | 11.6 | | 11.4 | 11.3 |
| G63 | 11.7 | 12.0 | 11.5 | | 11.5 |
| G0 | 9.16 | 8.4 | 8.1 | 7.6 | |

As shown in Tables 4 and 5, even when making the response time of liquid crystal fast by driving the liquid crystal display device in the high speed driving method, the response time of liquid crystal gets remarkably slow to deteriorate its picture quality if the using environment of the liquid crystal display device is low (0° C.) in temperature. As a result, the conventional liquid crystal display device has its picture quality changed because the response time of liquid crystal is changed if its category temperature is changed even though it is driven in the normal driving method as in FIG. 1 or in the high speed driving method.

SUMMARY OF THE INVENTION

Accordingly, the present invention is directed to a method and apparatus for measuring response time of liquid crystal, and method and apparatus for driving liquid crystal display device using the same that substantially obviates one or more of the problems due to limitations and disadvantages of the related art.

Accordingly, it is an object of the present invention to provide a method and apparatus for measuring the response time of the liquid crystal of which the optimal response time is automatically derived when the temperature of the liquid crystal is changed.

It is another object of the present invention to provide a method and apparatus for driving a liquid crystal display device that might minimize the deterioration of picture quality which is generated when the category temperature of the liquid crystal display device is changed on the basis of the optimal response time derived by the method and apparatus of measuring the response time of the liquid crystal.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for measuring response time of liquid crystal includes generating a liquid crystal driving signal having a variable voltage level that is changed in accordance with a response property of a liquid crystal display panel and a target voltage level, supplying the liquid crystal driving signal to the liquid crystal display panel, detecting the response property of the liquid crystal display panel corresponding to the liquid crystal driving signal, adjusting the variable voltage level until the response property reaches a desired level, setting a modulated data substantially equal to the variable voltage level when the response property reaches the desired level, and searching modulated data for different temperatures by changing the temperature of the liquid crystal display panel and by repeating the generating step, the supplying step, the detecting step, the adjusting step and the setting step.

In another aspect, the apparatus for measuring response time of liquid crystal, includes a temperature controller controlling temperature of a liquid crystal display panel, a signal generator generating a liquid crystal driving signal having a variable voltage level that is changed in accordance with a response property of the liquid crystal display panel and a target voltage level, and supplying the liquid crystal driving signal to the liquid crystal display panel, a detector detecting the response property of the liquid crystal display panel corresponding to the liquid crystal driving signal, and a level controller adjusting the variable voltage level until the response property reaches a desired level and setting a modulated data substantially equal to the variable voltage level when the response property reaches the desired level, the modulated data based on temperatures being determined by changing the temperature of the liquid crystal display panel through the temperature controller.

In yet another aspect, the method for driving a liquid crystal display device, includes storing modulation data corresponding to a plurality of temperature settings of a liquid crystal display panel, detecting a current temperature of the liquid crystal display panel, selecting the modulation data in accordance with the detected current temperature of the liquid crystal display panel, and modulating source data to be applied to the liquid crystal display panel using the selected modulation data.

In another aspect, the driving apparatus of a liquid crystal display device, includes a temperature sensor detecting a current temperature of a liquid crystal display panel, and a modulator storing modulation data corresponding to a plurality of temperature settings of the liquid crystal display panel, selecting the modulation data based on the detected current temperature of the liquid crystal display panel, and modulating source data to be applied to the liquid crystal display panel using the selected modulation data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will now be made in detail to the preferred embodiments, examples of which are illustrated in the accompanying drawings.

Figure 1:
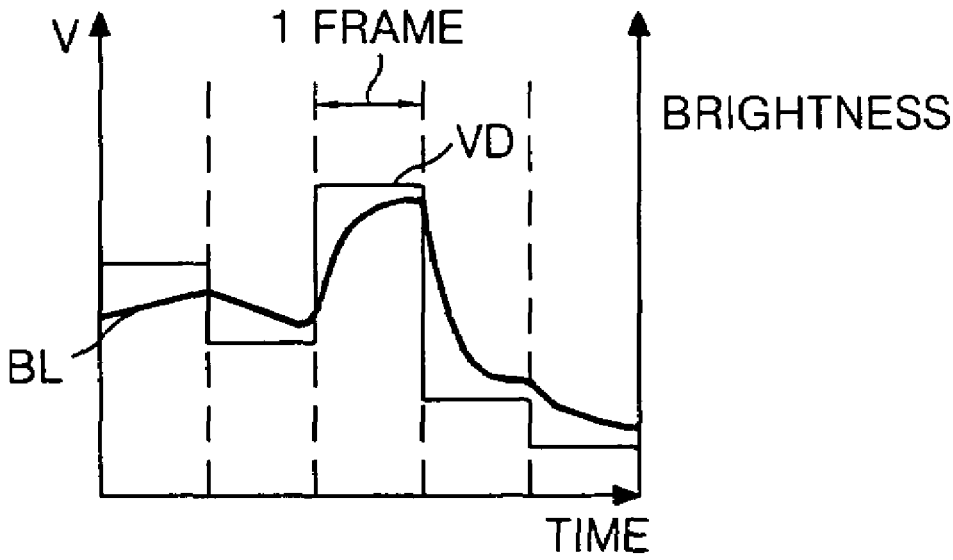
FIG. 1 RELATED ART
FIG. 1 is a diagram showing changes in brightness in accordance with data in a liquid crystal display device according to the related art.
Figure 2:
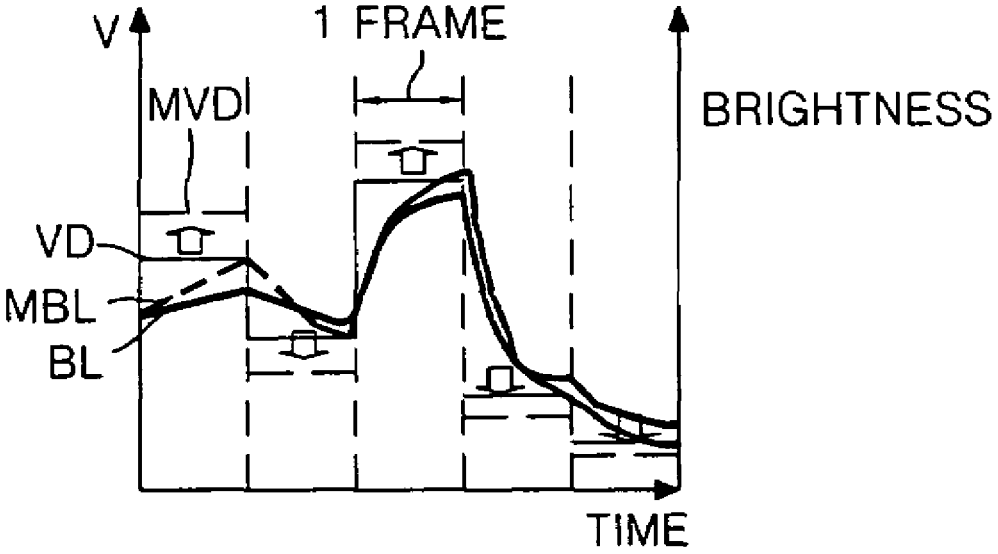
FIG. 2 RELATED ART
FIG. 2 is a diagram showing changes in brightness in a liquid crystal display device driven by a high speed driving method according to the related art.
Figure 3:
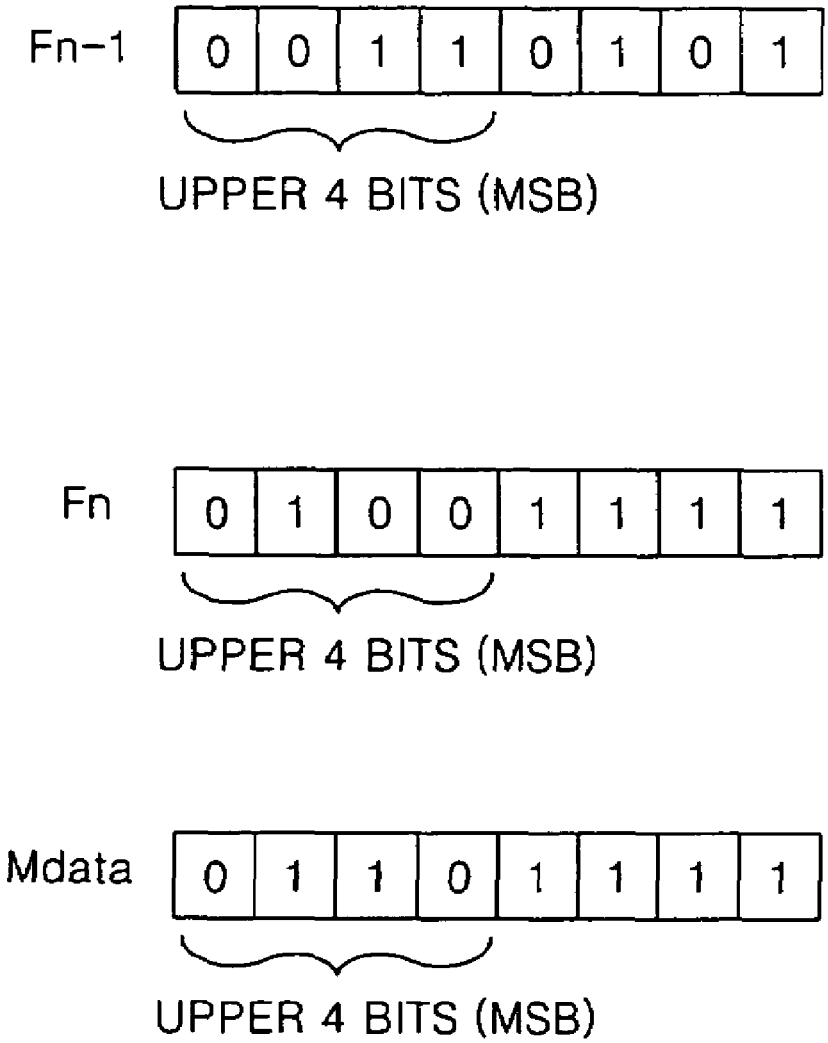
FIG. 3 RELATED ART
FIG. 3 is a diagram showing an example of eight-bit data using the high speed driving method according to the related art.
Figure 4:
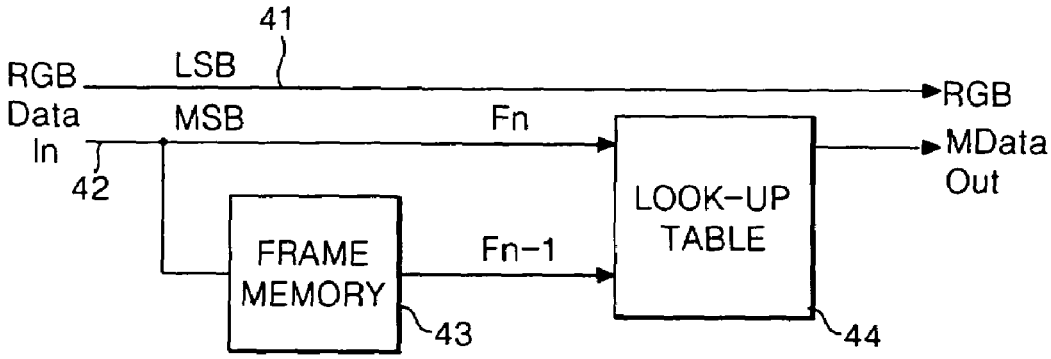
FIG. 4 RELATED ART
FIG. 4 is a block diagram of a high speed driving apparatus according to the related art.
Figure 5:
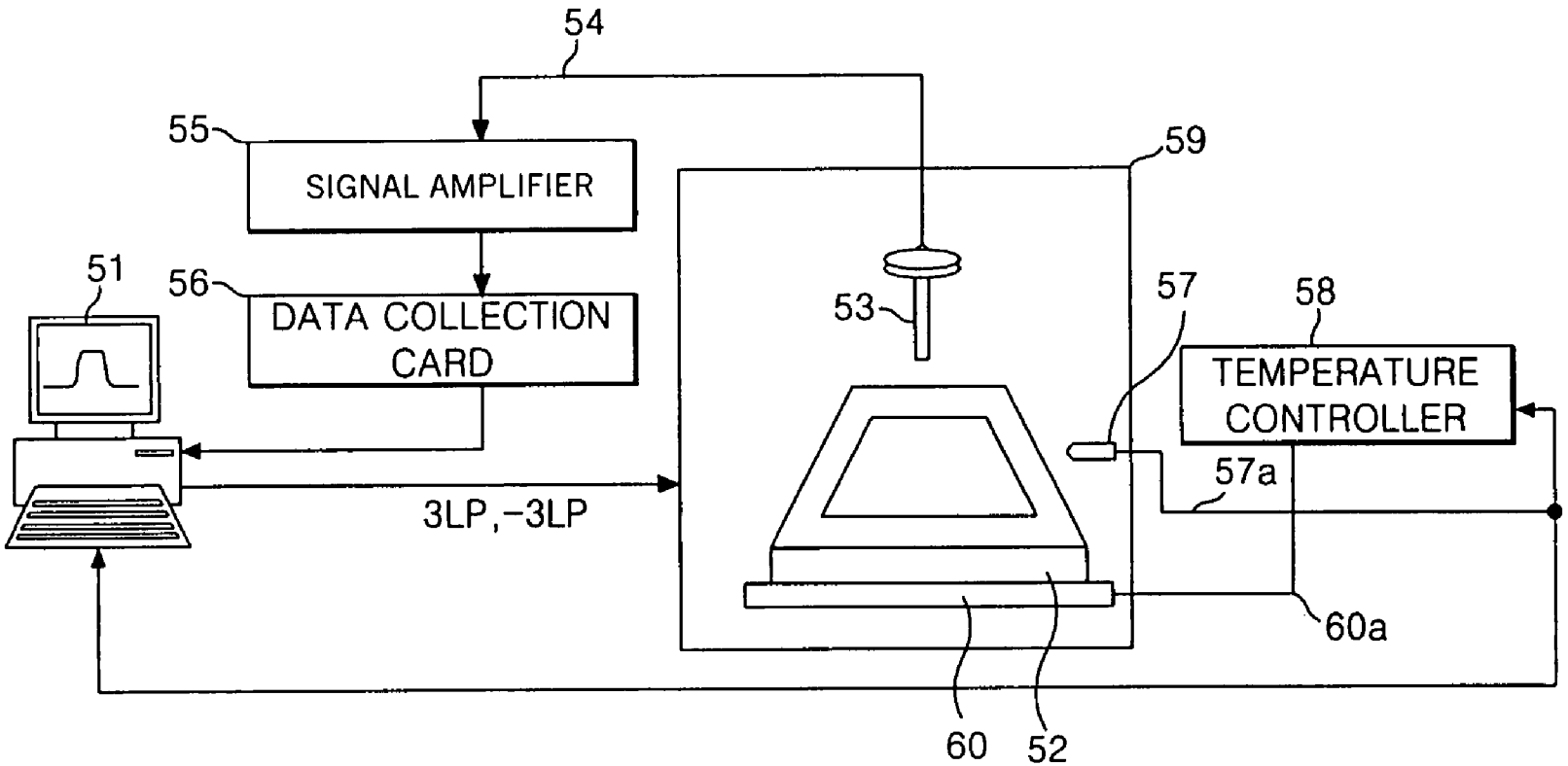
FIG. 5 is a diagram of an apparatus for measuring response time of liquid crystal according to an embodiment of the invention.

FIG. 5 is a schematic diagram of an apparatus for measuring response time of liquid crystal according to an embodiment of the invention. In FIG. 5, an apparatus for measuring response time of liquid crystal may include a temperature control chamber 59 in which a liquid crystal display panel sample 52 is loaded, a cooling/heating unit 60 for controlling temperature, a temperature sensor 57 for detecting surrounding temperature of the liquid crystal display panel sample 52, a temperature controller 58 connected to the temperature sensor 57 and the cooling/heating unit 60, a system 51 for supplying 3-level pulses to the liquid crystal display panel sample 52, a photodetector 53 for detecting light strength of a picture displayed on the liquid crystal display panel sample 52, and a signal amplifier 55 and a data collection card 56 connected between the photodetector 53 and the system 51.

In addition, the photodetector 53, a stage (not shown) for supporting the panel sample 52 thereon, and the cooling/heating unit 60 may be installed within the temperature control chamber 59. In particular, the temperature inside the temperature control chamber 59 may be controlled by the cooling/heating unit 60. For example, the cooling/heating unit 60 may generate or absorb heat in accordance with electrical signals such as current and voltage supplied from the temperature controller 58 via a first signal line 60*a*, thereby controlling the temperature inside the temperature control chamber 59.

The temperature sensor 57 may include a temperature sensor and maybe be installed within the temperature control chamber 59 for detecting the temperature inside the temperature control chamber 59 and for providing such detected temperature to the system 51 via a second signal line 57*a*. The detected temperature may be converted to digital signals by an analog to digital converter (hereinafter 'ADC', not shown) and be inputted to the system 51. Subsequently, the system 51 may regulate the temperature controller 58 based on the detected temperature to control the cooling/heating unit 60.

The system 51 may generate and supply 3-level pulses, 3LP and −3LP, to data lines (not shown) formed on the liquid crystal display panel sample 52. In addition, the system 51 may include a monitor and a driving circuit thereof to display on the monitor information, such as the characteristics of the 3-level pulses, 3LP and −3LP, and data received from the data collection card 56. The system 51 may also include a pattern control circuit and a program to adjust the 3-level pulses, 3LP and −3LP, manually by a human operator or automatically depending on the response property of liquid crystal in accordance with a pre-programmed control sequence. Further, the system 51 may display on the monitor the temperature detection signal received from the temperature controller 58 to allow the human operator to monitor the temperature of the temperature control chamber 59 in real time to thereby control the apparatus manually.

The liquid crystal display panel sample 52 may include liquid crystal material injected between two glass substrates, and data lines and gate lines formed on one of the two glass substrates. A thin film transistor (TFT) may be formed at each of intersections of the data lines and the gate lines, such that the TFT supplies data from the data lines to liquid crystal cells based on scan pulses. In addition, the liquid crystal display panel sample 52 may display a sample picture in accordance with the 3-level signal inputted from the system 51.

The photodetector 53 may be located within the temperature control chamber 59 facing pixels of the liquid crystal display panel sample 52 and may be connected to a signal amplifier 55 via a third signal line 54 that is connected through the temperature control chamber 59. The photodetector 53 may photo-electrically convert light incident from the sample picture displayed on the liquid crystal display panel sample 52. In addition, current outputted from the photodetector 53 may be proportional to strength of light being displayed on the liquid crystal display panel sample 52. The photodetector 53 may include one of a photodiode and a photo multiplier tube (PMT).

In addition, the signal amplifier 55 may amplify the light detection signal from the photodetector 53 and may supply the amplified light detection signal to the data collection card 56. Further, the data collection card 56 may convert the amplified light detection signal from the signal amplifier 55 into a digital signal which can be supplied to the system 51 and be analyzed by the system 51.

Figure 6:
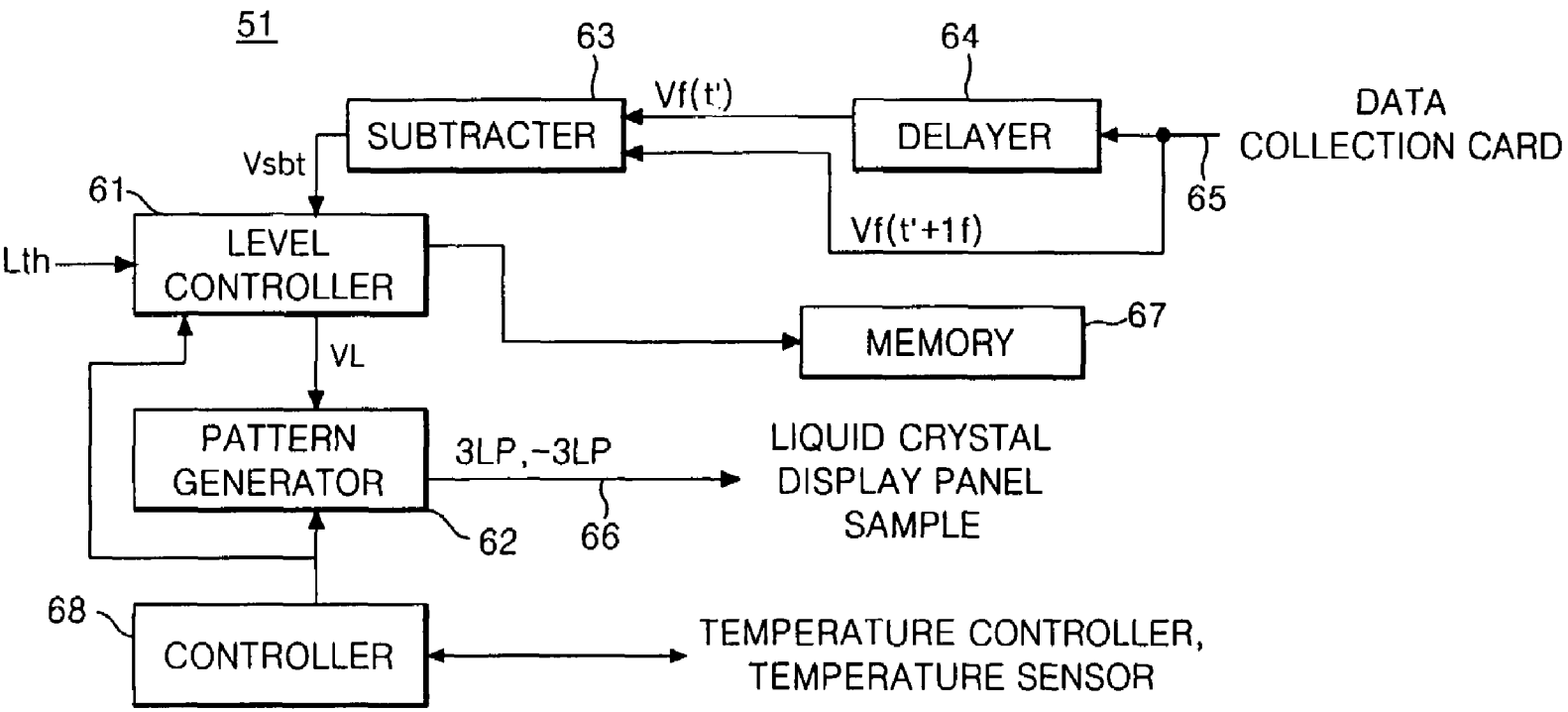
FIG. 6 is a block diagram of the system in FIG. 5.

FIG. 6 is a block diagram of the system in FIG. 5. In FIG. 6, the system 51 may include a pattern generator 62, a subtracter 63 connected to the data collection card 56, shown in FIG. 5, via an input line 65 and a delayer 64, a level controller 61 connected between the subtracter 63 and the pattern generator 62, a memory 67 connected to the level controller 61, and a controller 68 connected to the level controller 61 and the pattern generator 62. The signal generator 62 may generate 3-level signals of positive or negative polarity, 3LP and −3LP, under control of the controller 68 and the level controller 61. In addition, the 3-level signals, 3LP and −3LP may be supplied to the data line of the liquid crystal display panel sample 52 shown in FIG. 5.

Further, the subtracter 63 may receive a delayed signal Vf(t') from the delayer 64 which delays the signal from the data collection card 56 for one frame period, and may also received an undelayed signal Vf(t'+1f) from the data collection card 56. The subtracter 63 may perform a subtraction operation on the undelayed signal Vf(t'+1f) and the delayed signal Vf(t') to thereby provide a voltage difference signal Vsbt. The voltage different signal Vsbt may then be supplied to the level controller 61.

The level controller 61 may include a predetermined margin value Lth, such that the level controller 61 may compare the margin value Lth with the voltage difference Vsbt under control of the controller 68. When the voltage difference Vsbt is determined to be bigger than the margin value Lth, the level controller 61 may adjust a variable level VL accordingly and supply the adjusted variable level VL to the pattern generator 62. When the voltage difference Vsbt is determined to be smaller than the critical value Lth, the level controller 61 may store the variable level VL without an adjustment as modulation data voltage in the memory 67 for forming a look-up table (not shown).

The controller 68 may control the temperature controller 58 (shown in FIG. 5) to maintain a first temperature inside the temperature control chamber 59 (shown in FIG. 5), while determining optimal modulation data for each gray scale at the first temperature. Then, the controller 68 may repeat to thereby determine optimal modulation data for each gray scale at a different temperature. For example, the controller 68 may control patterns of the 3-level pulses, 3LP and −3LP, being supplied to the liquid crystal display panel sample 52, and may control the level controller 61 for determining the modulation data voltage based on data received by the photodetector 53 (shown in FIG. 5). In addition, the controller 68 may display information, such as the temperature detection data from the temperature sensor 57 and the temperature controller 58 (shown in FIG. 5) and the modulated data voltage, on the monitor of the system 51 for an human operator.

Figure 7A:
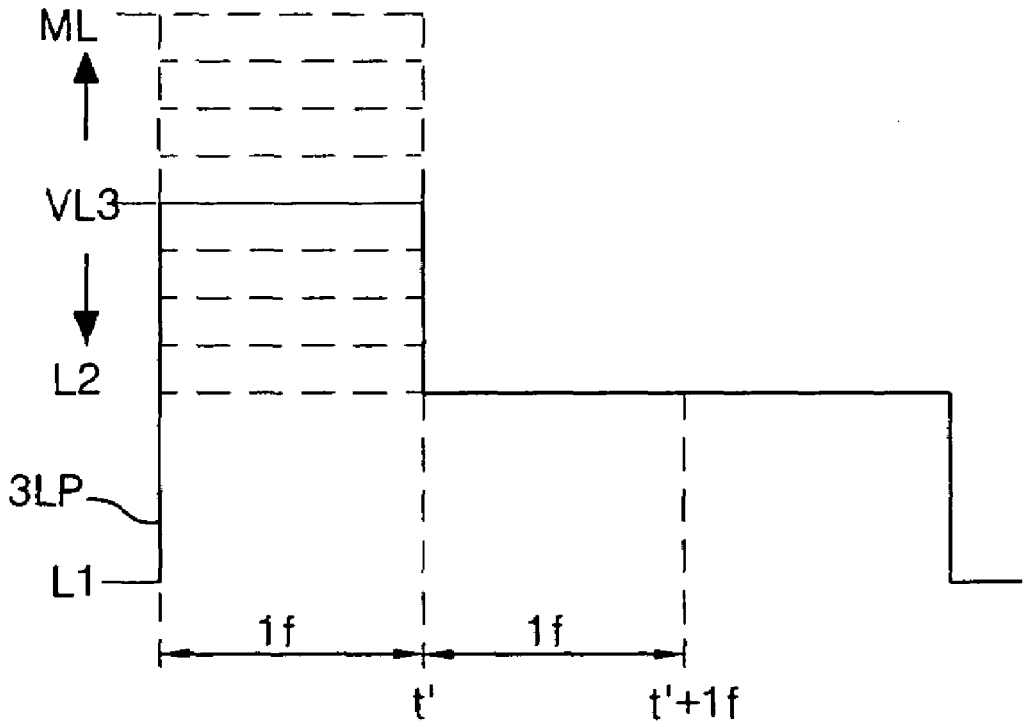
FIGS. 7A and 7B are diagrams of the 3-level pulses generated from the pattern generator in FIG. 6.
Figure 7B:
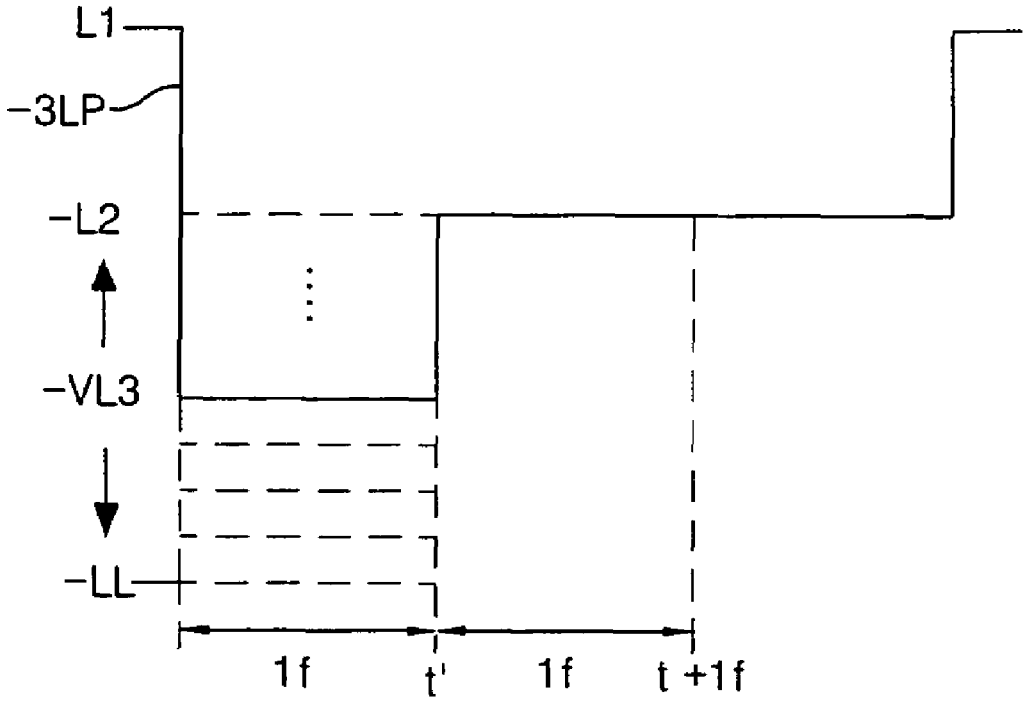

FIGS. 7A and 7B are diagrams of the 3-level pulses generated from the pattern generator 62 in FIG. 6. In FIG. 7A, the positive-polarity 3-level signal 3LP may include a ground level L1, a positive target level L2 higher than the ground level L1, and a positive variable level VL3 which remains constant for one frame period If. In addition, values of the ground level L1 and the positive target level L2 may be fixed, while the positive variable level VL3 may be changed. Further, the positive variable level VL3 may be a potential higher than the positive target level VL2 but lower than an uppermost positive potential ML. For example, the positive variable level VL3 may be the same as the adjusted variable level VL from the level controller 61.

In FIG. 7B, the negative-polarity 3-level signal −3LP may include a ground level L1, a negative target level −L2 lower than the ground level L1, and a negative variable level −VL3 which remains constant for one frame period If. In addition, values of the ground level L1 and the negative target level −L2 may be fixed, while a value of the negative variable level −VL3 may be changed. Further, the negative variable level −VL3 may be a potential lower than the negative target level −L2 but higher than a lowermost negative potential −LL. For example, the negative variable level −VL3 may be the same as the negative of the adjusted variable level VL from the level controller 61.

A length of the one frame period 1f during which the variable levels VL3, −VL3 remain constant may determined based on a driving frequency of a display device. For example, the one frame period 1f may be about 20.00 ms if the driving frequency is about 50 Hz, may be about 16.67 ms if the driving frequency is about 60 Hz, may be about 14.29 ms if the driving frequency is about 70 Hz, and may be about 12.50 ms if the driving frequency is about 80 Hz.

Figure 8:
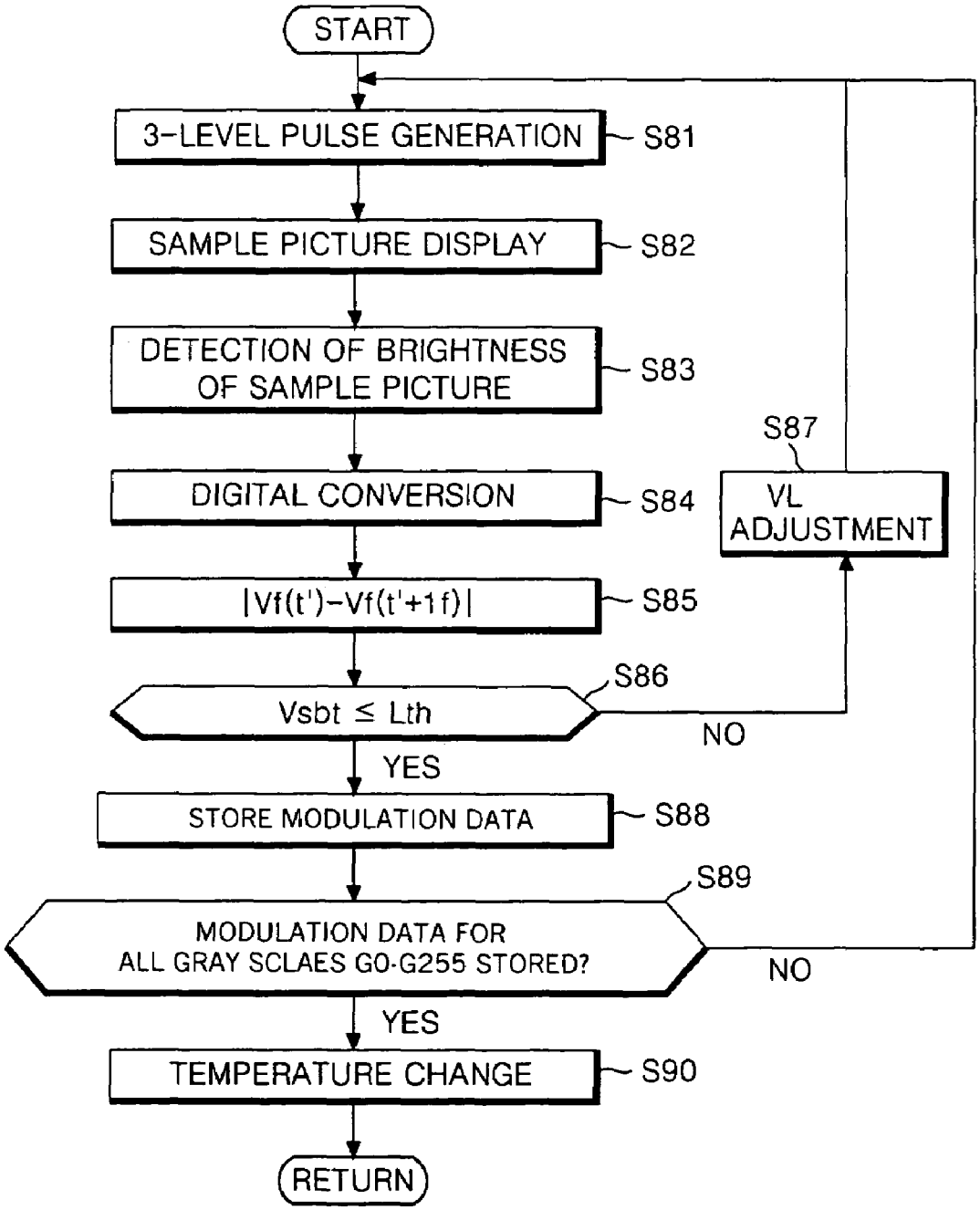
FIG. 8 is a flow chart showing a method for measuring response speed according to the embodiment.

FIG. 8 is a flow chart showing a method for measuring response speed according to an embodiment. In FIG. 8, at step S81, 3-level pulses may be generated by the pattern generator 62 (shown in FIG. 6). At step S82, a sample picture may be displayed on the liquid crystal display panel sample 52 (shown in FIG. 5) in accordance with the 3-level pulses. At step S83, brightness of the sample picture may be detected using the photodetector 53 (shown in FIG. 5). Then, at step S84, such a detected signal may be converted to a digital signal. Alternatively, such a detected signal may be first amplified (not shown) and then converted to the digital signal. In addition, the digital signal may be analyzed by the system 51 (shown in FIG. 5). For example, at step S85, a subtraction operation may be made between an one-time-frame-delayed digital signal Vf(t') and an undelayed digital signal Vf(t') by the subtracter 63 (shown in FIG. 6) to determine an absolute value of a voltage difference Vsbt.

At step S86, the voltage difference Vsbt may be compared to a predetermined margin value Lth at the level controller 61 (shown in FIG. 6). If the voltage difference Vsbt is determined to be bigger than the margin value Lth, current modulation data used to drive the liquid crystal display panel sample 52 (shown in FIG. 5) may be considered less than optimal. Thus, at step 87, a variable level VL may be adjusted according to the comparison result. Then, at step S81, different 3-level pulses may be generated using such an adjusted variable level VL, and steps S82-86 may be repeated until optimal modulation data is determined. That is, if at step S86, the voltage difference Vsbt is determined to be smaller or equal to the margin value Lth, the current variable level VL may be considered optimal. Then, at step S88, the current variable level VL may be considered as the optimal modulation data and may be stored in the memory 67 (shown in FIG. 6) for forming a look-up table (not shown).

Further, at step S89, if it is determined that optimal modulation data generation for each of gray scales G0-G255 is not completed, steps S81-S88 may repeated. However, if it is determined that optimal modulation data generation for each of the gray scales G0-G255 is completed, the temperature surrounding the liquid crystal display panel sample 52 (shown in FIG. 5) may then be changed at step 90. Then, the same steps S81-S89 may be repeated to determine optimal modulation data for each of gray scales G0-G255 at a different temperature. That is, throughout the steps S81-S89 may be maintained constant while optimal modulation data are to determined for all gray scales G0-G255. For example, the temperature may begin at a low temperature of about −20° C.-10° C., then change to a normal temperature of about 15° C.-35° C., further change to a high temperature of about 40° C.-70° C., and change back to the low temperature of about −20° C.-10° C.

In addition, steps S81-S90 may be carried by a program stored at a ROM inside the system 51 (shown in FIG. 5) which may be executed by a human operator. Further, the determined optimal modulation data for each gray scale at different temperatures may be stored as a look-up table in the memory 67 (shown in FIG. 6). For example, the determined optimal modulation data at the low temperature may be registered at a low temperature look-up table, the determined optimal modulation data at the normal temperature may be registered at a normal temperature look-up table, and the determined optimal modulation data may be registered at a high temperature look-up table.

Figure 9A:
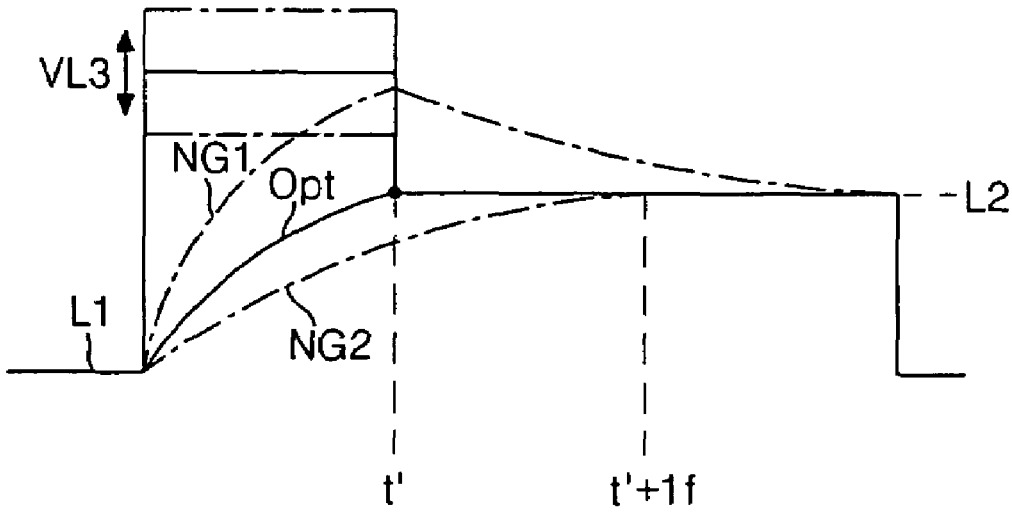
FIGS. 9A and 9B are diagrams of the 3-level pulse and the response property of liquid crystal according to the embodiment.
Figure 9B:
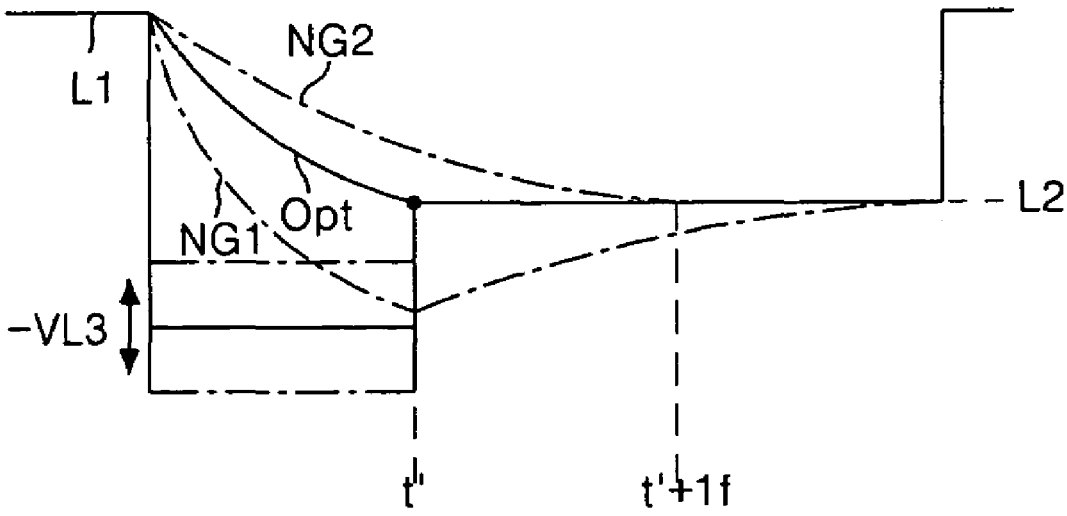
Figure 10A:
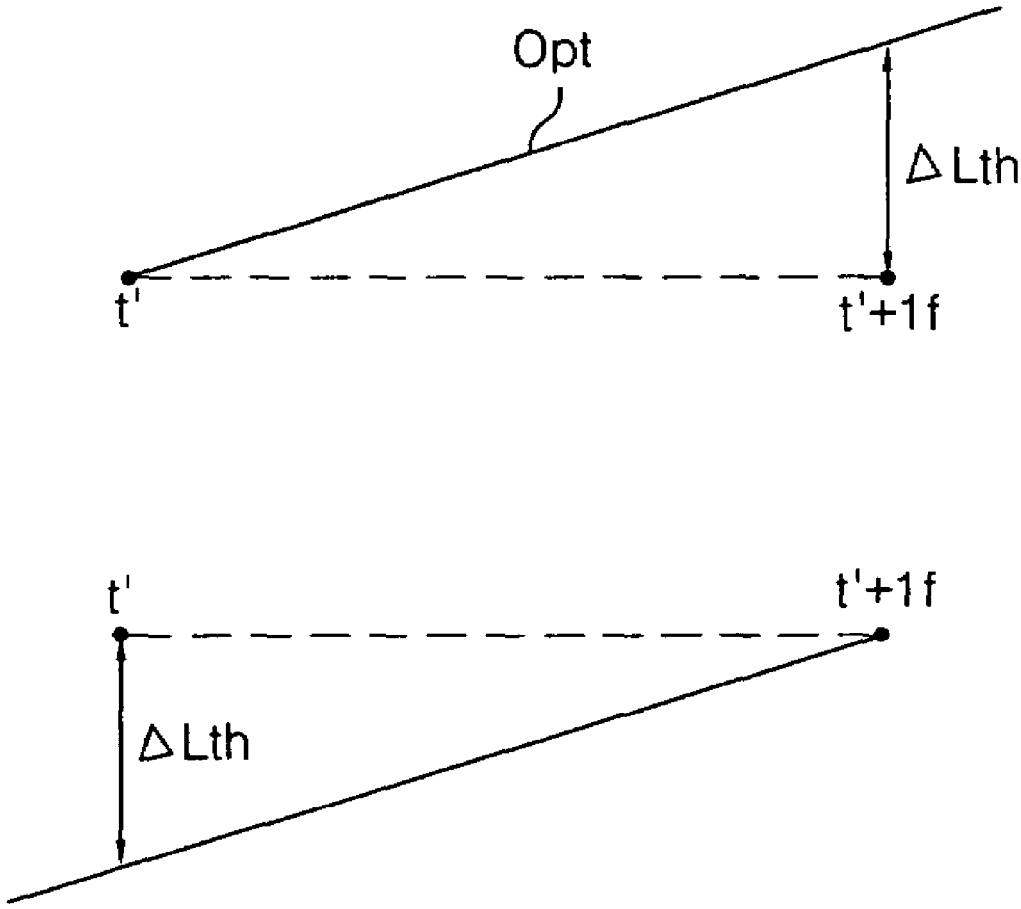
FIGS. 10A and 10B are diagrams of the relationship between a margin value and an optimal response property according to the embodiment.
Figure 10B:
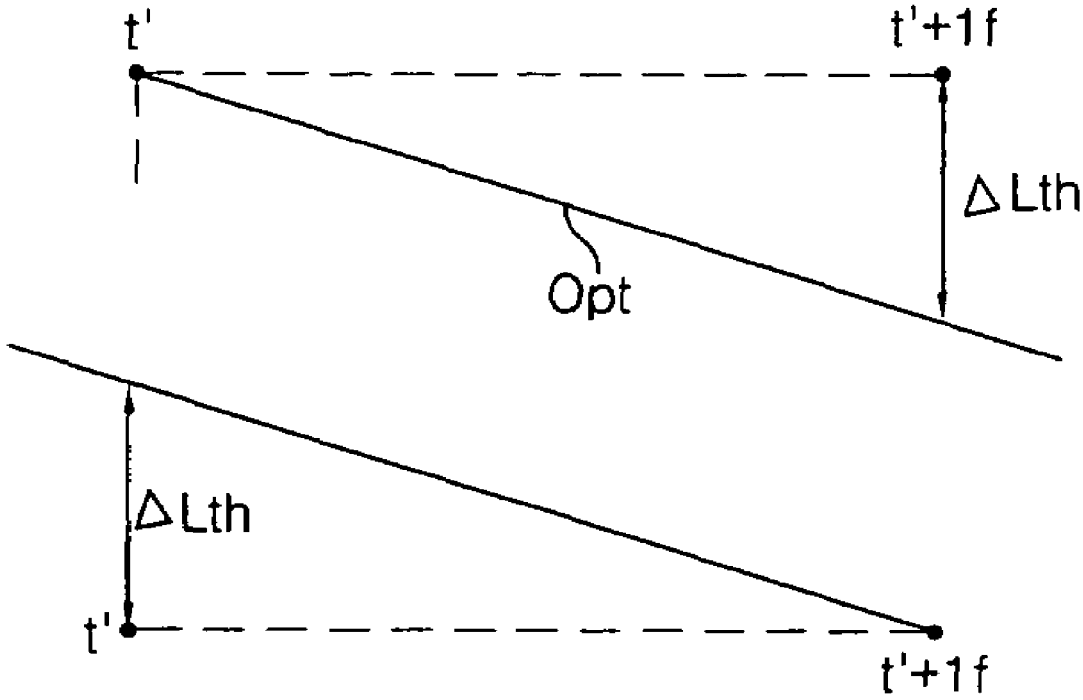

FIGS. 9A and 9B are diagrams of the 3-level pulse and the response property of liquid crystal according to the embodiment, and FIGS. 10A and 10B are diagrams of the relationship between a margin value and an optimal response property according to the embodiment. In FIGS. 9A and 9B, as a value of the variable level VL3 or −VL3 changes, a response of liquid crystal also changes. Thus, if the variable level VL3 or −VL3 is higher or lower than an optimal value, corresponding responses of the liquid crystal NG1 and NG2 may also be higher and lower than optimal response Opt at an end of a time frame t'. In addition, in FIGS. 10A and 10B, the optimal response Opt may be a target level or less than a predetermined margin value Lth at the end of a time frame, t' or t'+1f, having an insignificant difference from the target level. Accordingly, an optimal modulation data may be determined by comparing a difference in the response properties between the ending point of time (t') of one time frame and the ending point (t'+1f) of the next time frame with the margin value Lth.

Figure 11:
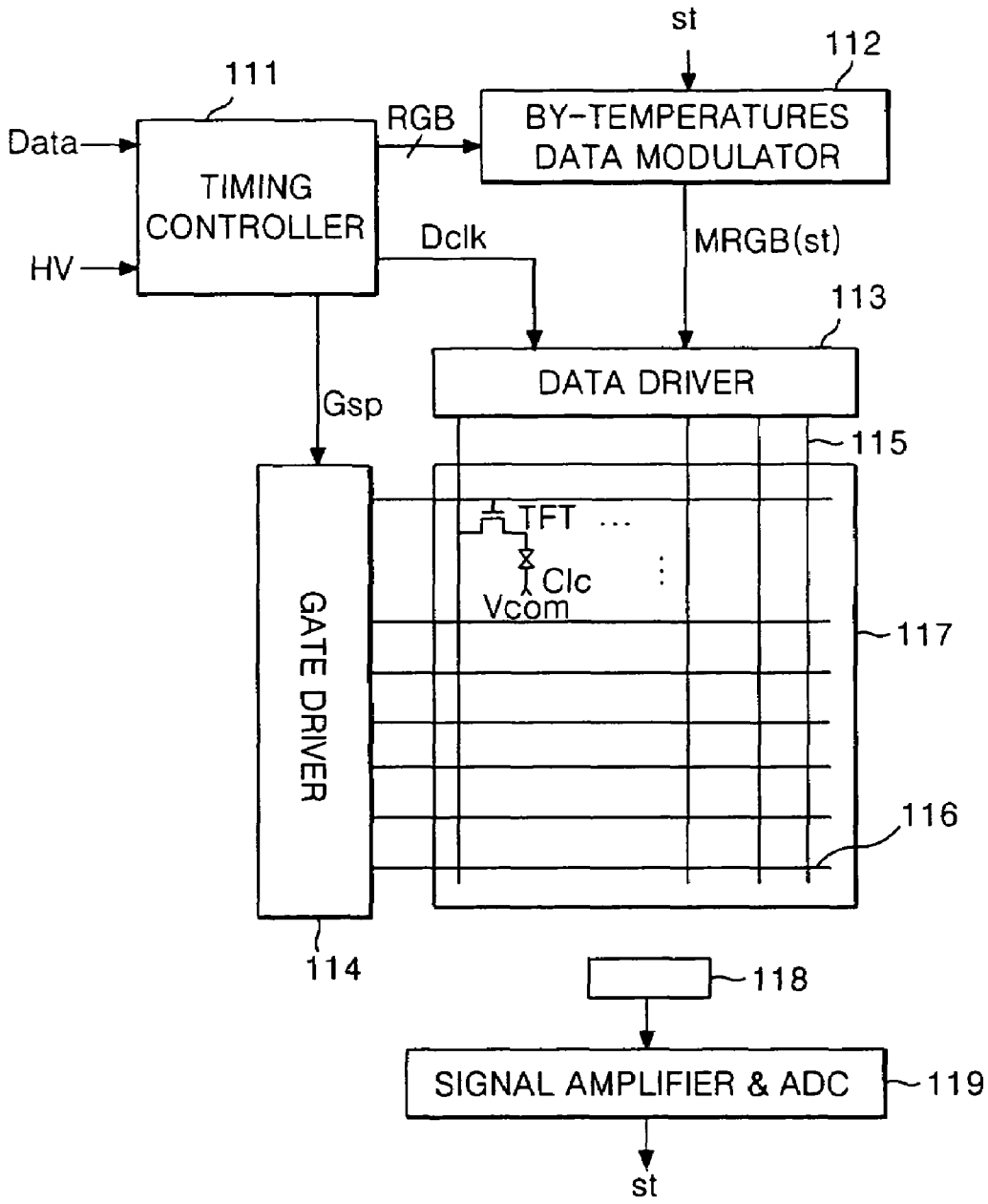
FIG. 11 is a block diagram of a driving apparatus of a liquid crystal display device according to another embodiment.

FIG. 11 is a block diagram of a driving apparatus of a liquid crystal display device according to another embodiment. In FIG. 11, a liquid crystal display device may include a liquid crystal display panel 117 in which TFTs for driving liquid crystal cell Clc are formed at intersections of data lines 115 and gate lines 116. In addition, a data driver 113 for supplying data to the data lines 115 of the liquid crystal display panel 117, a gate driver 114 for supplying scan pulses to the gate line 116 of the liquid crystal display panel 117, the driving apparatus may include a temperature sensor 118 for detecting temperature of the liquid crystal display panel 117, and a by-temperatures data modulator 112 to modulate data RGB based on the detected temperature.

The temperature sensor 118 may be installed in the vicinity of the liquid crystal display panel 117 or mounted on the substrate of the liquid crystal display panel 117 for detecting temperature of its surrounding and for generating a temperature sensing signal indicating the detected temperature. In addition, the temperature sensing signal may be amplified and converted into a digital temperature data (st) using the signal amplifier and the ADC 119. Further, the digital temperature data (st) may be supplied to the by-temperatures data modulator 112.

The data driver 113 receives modulated data MRGB(st) outputted from the by-temperatures data modulator 112 and supplies the modulated data MRGB(st) to the data lines 115 of the liquid crystal display panel 117 under control of a timing controller 111. In addition, the gate driver 114 supplies the scan pulses to the gate line 116 to turn on TFTs connected to the gate line 116, thereby selecting the liquid crystal cells Clc of one horizontal line. The data generated from the data driver 113 is synchronized with the scan pulse to be supplied to the liquid crystal cell Clc of the selected one horizontal line.

The timing controller 111 may generate a gate control signal Gsp to control the gate driver 114 and a data control signal Dclk to control the data driver 113 based on vertical/horizontal synchronization signals V, H and clocks. In addition, the timing controller 111 may supply digital video data RGB to the by-temperatures data modulator 112 and may control the operation timing of the by-temperatures data modulator 112.

The by-temperatures data modulator 112 may include optimal modulation data based on the pre-stored temperature. Thus, after receiving the digital temperature data (st) from the signal amplifier & ADC 119, the pre-stored by-temperatures modulated data may be searched in based on a by-temperatures optimal data search algorithm. Accordingly, the by-temperatures data modulator 112 may select the optimal modulation data corresponding to the detected temperature of the liquid crystal display panel 117 and may supply the selected optimal modulation data to the data driver 113.

The modulation data stored in a look-up table at the by-temperatures data modulator 112 have different values in accordance with the temperature, but it satisfies the following formula 3 to 5 regardless of the temperature.

$$VDn<VDn\text{-}1 \rightarrow MVDn<VDn \quad \text{[Formula 3]}$$

$$VDn=VDn\text{-}1 \rightarrow MVDn=VDn \quad \text{[Formula 4]}$$

$$VDn>VDn\text{-}1 \rightarrow MVDn>VDn, \quad \text{[Formula 5]}$$

where VDn-1 represents the data voltage of a previous frame Fn, VDn represents the data voltage of a current frame Fn, and MVDn represents modulated data voltage.

Figure 12:
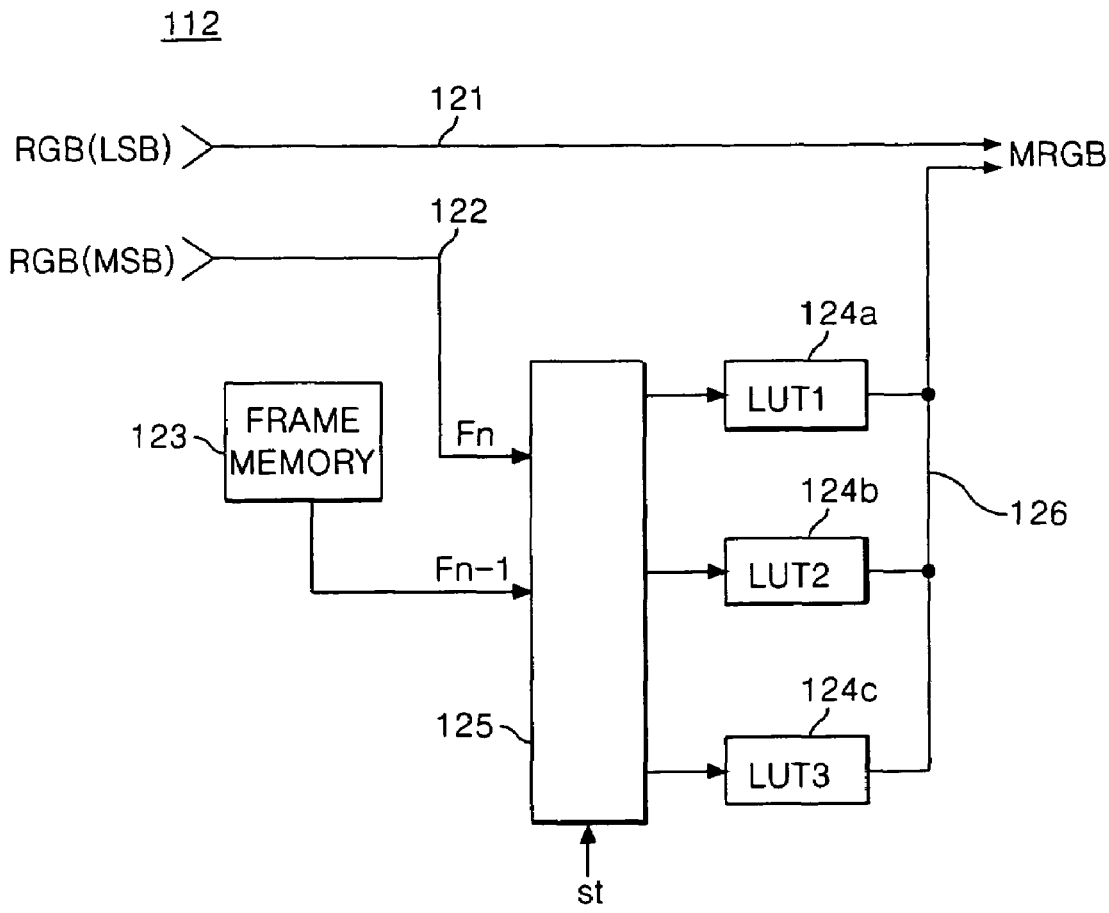
FIG. 12 is a block diagram of a first configuration of the by-temperatures data modulator in FIG. 11.

FIG. 12 is a block diagram of a first configuration of the by-temperatures data modulator in FIG. 11. In FIG. 12, the by-temperatures data modulator 112 may include a lower bit bus line 121 to transmit lowermost bits of the digital video data RGB(LSB), a frame memory 123 connected to an upper bit bus line 122, a selector 125 connected to the upper bit but line 122 and the frame memory 123, and a first, second and third look-up tables 124*a*, 124*b* and 124*c* connected between the selector 125 and an upper bit output line 126. For example, the lowermost bits of the digital video data RGB(LSB) may include lower four bits of an eight-bit source data and may bypass to an output. In addition, the frame memory 123 may store upper bits of the digital video data RGB(MSB) of a current frame Fn for one frame period and then supply the stored data to the selector 125, thereby delaying the upper bits MSB for one frame period Fn-1. The upper bits MSB may include upper four bits of the eight-bit source data and may be modulated. If only the upper bits MSB in the source data are modulated, the size of the look-up tables 124*a*, 124*b* and 124*c* and the volume of memory where the look-up tables 124*a*, 124*b* and 124*c* are stored may be reduced. Alternatively, the entire eight-bit source data may be modulated.

The selector 125 may receive the detected temperature signal (st). If the detected temperature signal (st) is determined as a high temperature of, for example, about 40° C.-70° C., the selector 125 may use the first look-up table 124*a*, in which the optimal modulation data for the high temperature may be pre-stored. The first look-up table 124*a* may be searched using the method shown in FIG. 8. The first look-up table 124*a* may compare the upper bit data RGB(MSB) of the current frame Fn with the upper bit data RGB(MSB) of the previous frame Fn-1 and may select the optimal modulation data for the high temperature based on the comparison result.

In addition, if the detected temperature signal (st) is determined as a normal temperature of, for example, about 15° C.-35° C., the selector 125 may use the second look-up table 124*b*, in which the optimal modulation data for the normal temperature may be pre-stored. The second look-up table 124*b* may be searched using the method shown in FIG. 8. The second look-up table 124*b* may compare the upper bit data RGB(MSB) of the current frame Fn with the upper bit data RGB(MSB) of the previous frame Fn-1 and may select the optimal modulation data for the normal temperature pre-stored based on the comparison result. If the source data is modulated to the modulated data MRGB at a normal temperature, e.g., 25° C., using the second look-up table 124*b* and supplied to the data driver 113, the response time of liquid crystal is shown as in Table 5.

Further, if the detected temperature signal st is determined as a low temperature of, for example, about −20° C.-10° C., the selector 125 may use the third look-up table 124*c*, in which the optimal modulation data for the low temperature may be pre-stored. The third look-up table 124*c* may be searched using the method shown in FIG. 8. The third look-up table 124*c* may compare the upper bit data RGB(MSB) of the current frame Fn with the upper bit data RGB(MSB) of the previous frame Fn-1 and may select the optimal modulation data for the low temperature based on the comparison result.

If the source data is modulated to the modulated data MRGB at a low temperature, e.g., 0° C., using the third look-up table 124C and supplied to the data driver 113, the response time of liquid crystal is shown as in Table 6.

The Table 6 represents the liquid crystal response time ms at the rising time and the falling time of each of gray scales 0(G0), 63(G63), 127(G127), 191(G191), 255(G255) when 30" liquid crystal display module of resolution 1280×768 is driven in use of the optimal modulated data of low temperature determined by the method shown in FIG. 8 carried out at 0° C.

TABLE 6

| | Rising time | | | | |
|---|---|---|---|---|---|
| Falling time | G255 | G191 | G127 | G63 | G0 |
| G255 | | 8.9 | 9.7 | 9.8 | 10.7 |
| G191 | 9.8 | | 10.0 | 10.2 | 9.8 |
| G127 | 10.7 | 10.7 | | 9.3 | 9.7 |
| G63 | 10.6 | 10.8 | 10.5 | | 9.8 |
| G0 | 8.6 | 7.4 | 7.0 | 7.0 | |

Comparing Table 4 and Table 6, the liquid crystal display device driven by the driving apparatus according to the embodiment may have faster response time even at a low temperature. Also, the liquid crystal display device driven by the driving apparatus according to the embodiment may determine the optimal modulation data by high, normal and low temperatures in use of the method shown in FIG. 8 to form look-up tables, and may select the optimal modulation data from the look-up tables to modulate the source data based on a detected temperature of the liquid crystal display panel 117. Accordingly, the liquid crystal display device according to the embodiment may have its optimal picture quality even as the temperature of the liquid crystal display panel 117 changes.

Figure 13:
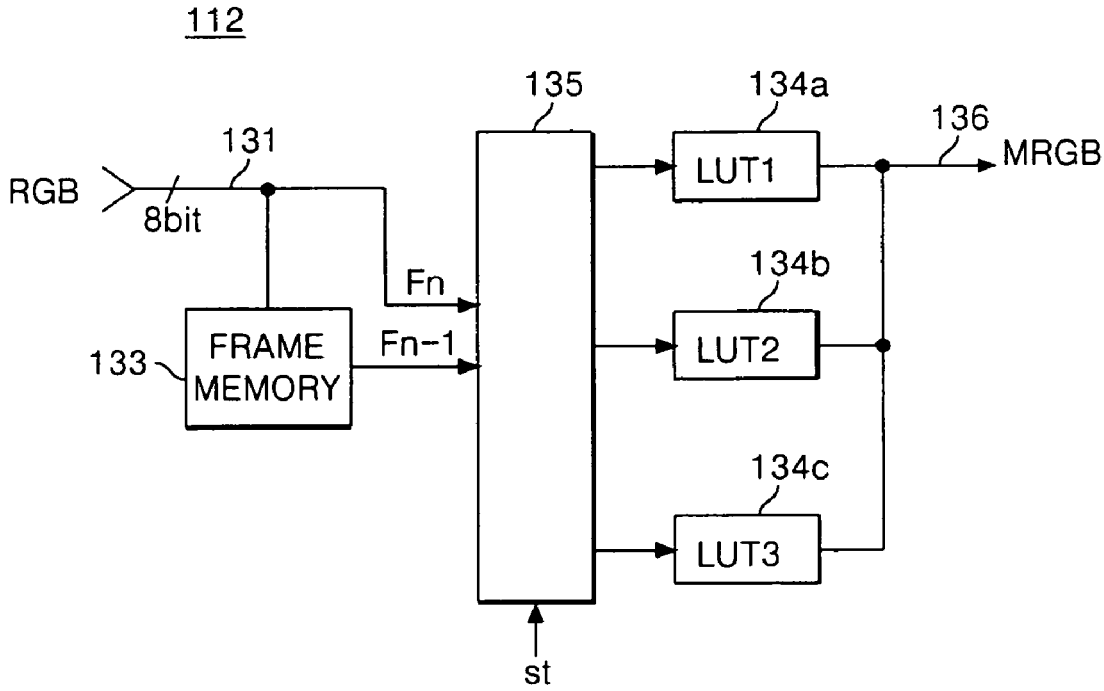
FIG. 13 is a block diagram of a second configuration of the by-temperatures data modulator in FIG. 11.

FIG. 13 is a block diagram of a second configuration of the by-temperatures data modulator in FIG. 11. In FIG. 13, the by-temperature data modulator 112 may modulate all bits of the source data to thereby provide even better picture quality. The by-temperature data modulator 112 may include a frame memory 133 connected to a full bit source data bus line 131, a selector 135 connected to the source data bus line 131 and the frame memory 133, and a first, second, and third look-up tables 134*a*, 134*b* and 134*c* connected between the selector 135 and a modulated data output line 136. The frame memory 133 may store source data RGB having 8 bits of a current frame Fn for one frame period and then supply the stored data to the selector 135, thereby delaying the source data RGB for one frame period.

The selector 135 may receive the detected temperature signal st. If the detected temperature signal st is determined as a high temperature of, for example, about 40° C.-70° C., the selector 135 may use the first look-up table 134*a*, in which the optimal modulation data for the high temperature may be pre-stored. The first look-up table 134*a* may compare the source data RGB of the current frame Fn with the source data RGB of the previous frame Fn-1 inputted from the selector 135 and may select the optimal modulation data for the high temperature based on the comparison result.

In addition, if the detected temperature signal st is determined as a normal temperature of, for example, about 15° C.-35° C., the selector 135 may use the second look-up table 134*b*, in which the optimal modulation data for the normal temperature may be pre-stored. The second look-up table 134*b* may compare the source data RGB of the current frame Fn with the source data RGB of the previous frame Fn-1 inputted from the selector 135 and may select the optimal modulation data for the normal temperature based on the comparison result.

Further, if the detected temperature signal st is determined as a low temperature of for, example, about −20° C.-10° C., the selector 135 may use the third look-up table 134*c*, in which the optimal modulation data for the low temperature may be pre-stored. The third look-up table 134*c* may compare the source data RGB of the current frame Fn with the source data RGB of the previous frame Fn-1 inputted from the selector 135 and may select the optimal modulation data for the low temperature based on the comparison result.

The above-described method and apparatus of measuring the response time of liquid crystal according to the embodiment automatically search for the optimal modulation data of each gray scale using 3-level signals for different temperatures, so that the optimal modulation data can automatically be selected based on a detected temperature of a liquid crystal display panel to ensure a fast response time of liquid crystal despite temperature changes.

In addition, the above-described driving method and apparatus of the liquid crystal display device according to the embodiment compose a look-up table using a method and apparatus of measuring the response time of liquid crystal, select from the look-up table the optimal modulation data based on a current temperature of the liquid crystal display panel detected using a temperature sensor, and modulate source data with the selected optimal modulation data, thereby minimizing deterioration of picture quality caused by changes in temperature of the liquid crystal display device.

It will be apparent to those skilled in the art that various modifications and variations can be made in the method and apparatus for measuring response time of liquid crystal, and the method and apparatus for driving liquid crystal display device using the same of the invention without departing from the spirit or scope of the invention. Thus, it is intended that the embodiments of the invention cover the modifications and variations of this invention provided they come within the scope of the appended claims and their equivalents.

What is claimed is:

1. A method for measuring response time of liquid crystal, comprising:

generating a liquid crystal driving signal having a variable voltage level that is changed in accordance with a response property of a liquid crystal display panel and a target voltage level;

supplying the liquid crystal driving signal to the liquid crystal display panel;

detecting the response property of the liquid crystal display panel corresponding to the liquid crystal driving signal;

adjusting the variable voltage level until the response property reaches a desired level;

setting a modulated data substantially equal to the variable voltage level when the response property reaches the desired level; and searching modulated data for different temperatures by changing the temperature of the liquid crystal display panel and by repeating the generating step, the supplying step, the detecting step, the adjusting step and the setting step;

wherein the modulated data comprises:

a high temperature modulation data for the liquid crystal display panel in high temperature;

a normal temperature modulation data for the liquid crystal display panel in normal temperature; and a low temperature modulation data for the liquid crystal display panel in low temperature.

2. The method according to claim 1, wherein the detecting the response property comprises:

detecting a brightness of the liquid crystal display panel;

generating a voltage signal corresponding to the detected brightness;

delaying the voltage signal for one time frame;

detecting a difference between the delayed voltage signal and a non-delayed voltage signal; and comparing the difference with a predetermined critical value to determine whether the response property reaches the desired level based on the comparison result.

3. A liquid crystal display device including the liquid crystal display panel measured by the method according to claim 1, wherein the liquid crystal display panel comprises first and second substrates bonded to each other with a predetermined space therebetween, and the predetermined space is filled with the liquid crystal.

4. An apparatus for measuring response time of liquid crystal, comprising:

a temperature controller controlling temperature of a liquid crystal display panel;

a signal generator generating a liquid crystal driving signal having a variable voltage level that is changed in accordance with a response property of the liquid crystal display panel and a target voltage level, and supplying the liquid crystal driving signal to the liquid crystal display panel;

a detector detecting the response property of the liquid crystal display panel corresponding to the liquid crystal driving signal; and a level controller adjusting the variable voltage level until the response property reaches a desired level and setting a modulated data substantially equal to the variable voltage level when the response property reaches the desired level, the modulated data based on temperatures being determined by changing the temperature of the liquid crystal display panel through the temperature controller;

wherein the modulated data comprises:

a high temperature modulation data for the liquid crystal display panel in high temperature;

a normal temperature modulation data for the liquid crystal display panel in normal temperature; and a low temperature modulation data for the liquid crystal display panel in low temperature.

5. The apparatus according to claim 4, further comprising:

a temperature control chamber into which the liquid crystal display panel is loaded;

a temperature sensor detecting the temperature of the liquid crystal display panel; and a cooling/heating unit changing or maintaining the temperature within the temperature control chamber under control of the temperature controller.

6. The apparatus according to claim 5, further comprising:

a controller controlling the signal generator and the level controller and controlling the temperature controller in response to a temperature signal detected by the temperature sensor.

7. The apparatus according to claim 6, wherein the detector comprises a photodetector detecting a brightness of the liquid crystal display panel, and generates a voltage signal corresponding to the detected brightness, and wherein the level controller receives a first voltage signal of a previous time frame and a second voltage signal of a current time frame, detects a difference between the voltage signals, and compares the difference with a predetermined critical value to determine whether or not the response property reaches the desired level based on the comparison result.

8. The apparatus according to claim 6, wherein the liquid crystal driving signal comprises the target voltage level and the variable voltage level, and has a voltage level of at least 3.

9. A method for driving a liquid crystal display device, comprising:

storing modulation data corresponding to a plurality of temperature settings of a liquid crystal display panel;

detecting a current temperature of the liquid crystal display panel;

selecting the modulation data in accordance with the detected current temperature of the liquid crystal display panel; and modulating source data to be applied to the liquid crystal display panel using the selected modulation data;

wherein the modulation data comprises:

a high temperature modulation data for the liquid crystal display panel in high temperature;

a normal temperature modulation data for the liquid crystal display panel in normal temperature; and a low temperature modulation data for the liquid crystal display panel in low temperature.

10. The method according to claim 9, further comprising determining the modulation data corresponding to the temperature settings, wherein the step of determining the modulation data corresponding to the temperature settings includes:

driving the liquid crystal display panel with a liquid crystal driving signal having a variable voltage level that is changed in accordance with a response property of the liquid crystal display panel and a target voltage level;

detecting a brightness of the liquid crystal display panel corresponding to the liquid crystal driving signal; and setting the modulation data substantially equal to the variable voltage level of the liquid crystal driving data when the response property of the liquid crystal display panel reaches a desired level at a particular temperature.

11. The method according to claim 9, wherein the high temperature is about 40° C.~70° C., the normal temperature is about 15° C.~35° C., and the low temperature is about −20° C.~10° C.

12. The method according to claim 9, wherein one of the high temperature modulation data, the normal temperature modulation data and the low temperature modulation data is selected in accordance with the detected current temperature of the liquid crystal display panel for the selecting of the modulation data.

13. A driving apparatus of a liquid crystal display device, comprising:

a temperature sensor detecting a current temperature of a liquid crystal display panel; and a modulator storing modulation data corresponding to a plurality of temperature settings of the liquid crystal display panel, selecting the modulation data based on the detected current temperature of the liquid crystal display panel, and modulating source data to be applied to the liquid crystal display panel using the selected modulation data;

wherein the modulation data comprises:

a high temperature modulation data for the liquid crystal display panel in high temperature;

a normal temperature modulation data for the liquid crystal display panel in normal temperature; and a low temperature modulation data for the liquid crystal display panel in low temperature.

14. The apparatus according to claim 13, wherein the modulator includes:

a frame memory storing the source data from an input line;

a first look-up table having the high temperature modulation data;

a second look-up table having the normal temperature modulation data;

a third look-up table having the low temperature modulation data; and a selector supplying source data from the input line and source data from the frame memory to any one of the first, second and third look-up tables based on the detected current temperature.

15. The apparatus according to claim 14, wherein the high temperature is about 40° C.~70° C., the normal temperature is about 15° C.~35° C., and the low temperature is about −20° C.~10° C.

* * * * *